US008813668B2

(12) United States Patent
Askestad

(10) Patent No.: US 8,813,668 B2
(45) Date of Patent: Aug. 26, 2014

(54) DEVICE FOR ROTATING TURNTABLE

(75) Inventor: Sigmund Askestad, Tvedestrand (NO)

(73) Assignee: Advanced Production and Loading AS, Kolbjornsvik (NO)

( * ) Notice: Subject to any disclaimer, the term of this patent is extended or adjusted under 35 U.S.C. 154(b) by 169 days.

(21) Appl. No.: 13/635,816

(22) PCT Filed: Mar. 17, 2011

(86) PCT No.: PCT/NO2011/000089
§ 371 (c)(1),
(2), (4) Date: Nov. 16, 2012

(87) PCT Pub. No.: WO2011/115505
PCT Pub. Date: Sep. 22, 2011

(65) Prior Publication Data

US 2013/0199432 A1 Aug. 8, 2013

(30) Foreign Application Priority Data

Mar. 19, 2010 (NO) ..... 20100418

(51) Int. Cl.
*B63B 21/00* (2006.01)
*B63B 21/50* (2006.01)

(52) U.S. Cl.
CPC ..... *B63B 21/507* (2013.01)
USPC ..... 114/230.12; 441/5

(58) Field of Classification Search
USPC ..... 441/3–5; 114/230.12
IPC ..... B63B 21/507
See application file for complete search history.

(56) References Cited

U.S. PATENT DOCUMENTS

| | | | | |
|---|---|---|---|---|
| 5,266,061 | A | 11/1993 | Poldervaart et al. | |
| 5,359,957 | A | 11/1994 | Askestad | |
| 5,746,148 | A * | 5/1998 | Delago | 114/230.12 |
| 5,860,382 | A * | 1/1999 | Hobdy | 114/230.15 |
| 6,269,762 | B1 | 8/2001 | Commandeur | |
| 6,474,252 | B1 * | 11/2002 | Delago | 114/230.12 |
| 6,708,639 | B2 * | 3/2004 | Cottrell et al. | 114/230.12 |
| 6,990,917 | B2 * | 1/2006 | Boatman et al. | 114/230.12 |
| 8,671,864 | B2 * | 3/2014 | Lindblade et al. | 114/230.12 |
| 2003/0121465 | A1 * | 7/2003 | Boatman et al. | 114/230.12 |
| 2003/0154899 | A1 * | 8/2003 | Cottrell et al. | 114/230.12 |

FOREIGN PATENT DOCUMENTS

| | | | |
|---|---|---|---|
| GB | 2320231 | A | 6/1998 |
| WO | 93/07049 | A1 | 4/1993 |
| WO | 98/31585 | A1 | 7/1998 |
| WO | 98/41444 | A1 | 9/1998 |
| WO | 02/32753 | A1 | 4/2002 |

* cited by examiner

*Primary Examiner* — Stephen Avila
(74) *Attorney, Agent, or Firm* — Birch, Stewart, Kolasch & Birch, LLP

(57) ABSTRACT

A device for rotating a turntable includes a turret and a turntable bearing The turret is rotatable in a through-going opening or well in the hull of a vessel and has axial and radial bearing assemblies arranged in a polar array about the turret center line. In order to reduce the substantial wear caused by relative movements between the axial wheels of the bearing assembly and the circular rail on the bearing support structure, the axial wheels are conically shaped with a double curved surface rolling on the upward facing edge of the circular rail with a slope aligned with an extension line of the rail substantially intersecting with the shaft center line at the center line of the turret. The radial bearing assembly includes horizontally arranged radial wheels with double curved surfaces. Each wheel rolls on an inward facing edge of the circular rail.

15 Claims, 8 Drawing Sheets

DEVICE FOR ROTATING TURNTABLE

FIELD OF THE INVENTION

The invention relates to a device for a rotating turntable comprising a turret and turntable bearing for a vessel, such as a drilling or production vessel for recovery of oil offshore, the turret is rotatable in a through-going opening or well in the hull of the vessel and having axial and radial bearings assemblies arranged in a polar array about the turret centre line.

BACKGROUND OF THE INVENTION

Turret Wheel Bearing systems are known from U.S. Pat. No. 6,269,762 Vessel—turret assembly having radially guided bogie wheels and U.S. Pat. No. 5,359,957 Turret for Drilling or Production Ship.

Turret wheel bearing systems known have cylindrically shaped wheels.

Both these solutions have bogie wheels requiring two tracks. They are designed for large turret loads. Boggy systems are too comprehensive for less loaded turret bearings.

Turrets with single wheel systems such as the GNO patented turret bearing system are based on load sharing through a complicated hydraulic system involving a number of elements and wearable parts.

Other systems such as the AmClyde system is based on structural stiffness of a rigid structure with very small load sharing capabilities requiring very accurate machining of the various parts and vessel induced vessel deformations affects the load response substantial.

One major disadvantage with the cylindrically shaped wheels is that there will be substantial wear caused by relative movements between the wheel and the rail at the inward and the outward portions of the contact surfaces between the wheel and the rail. The reason is the longer circumference of the outward face of the rail than the inward face of the rail in combination with the great wheel width compared with the rail diameter.

SUMMARY OF THE INVENTION

The object of the invention is to avoid the above said disadvantages.

The object is obtained by the invention in that the axial bearing assembly includes axial wheel shafts acting as bearing arms, each axial wheel shaft having one axial wheel rolling on a circular rail on the bearing support structure, each axial wheel shaft secured to the turret structure, the axial wheels are conically shaped with a double curved surface rolling on the upward facing edge of the circular rail with a slope aligned with an extension line of the rail substantially intersecting with the shaft centre line at the centre line of the turret, the conically shaped axial wheels are substantially following the extension line of the rail, the radial bearing assembly includes horizontally arranged radial wheels with double curved surface, each wheel is mounted on a shaft secured to the turret, the radial wheels are rolling on an inward facing edge of the circular rail. Preferable embodiments of the invention are stated in the dependent claims.

The invention provides a turret with

- Improved wear conditions in the wheels with a simple spring system for load distribution.
- The structural spring system in U.S. Pat. No. 5,359,957 utilizing the inherent structural flexibility of the supportive structures is simplified using shafts with high fatigue strength and less wear.

- A simple method for retrieving the wheel with shaft for replacement.
- Means for fastening the rail to the support structure without welding.

DETAILED DESCRIPTION

Figure 1:
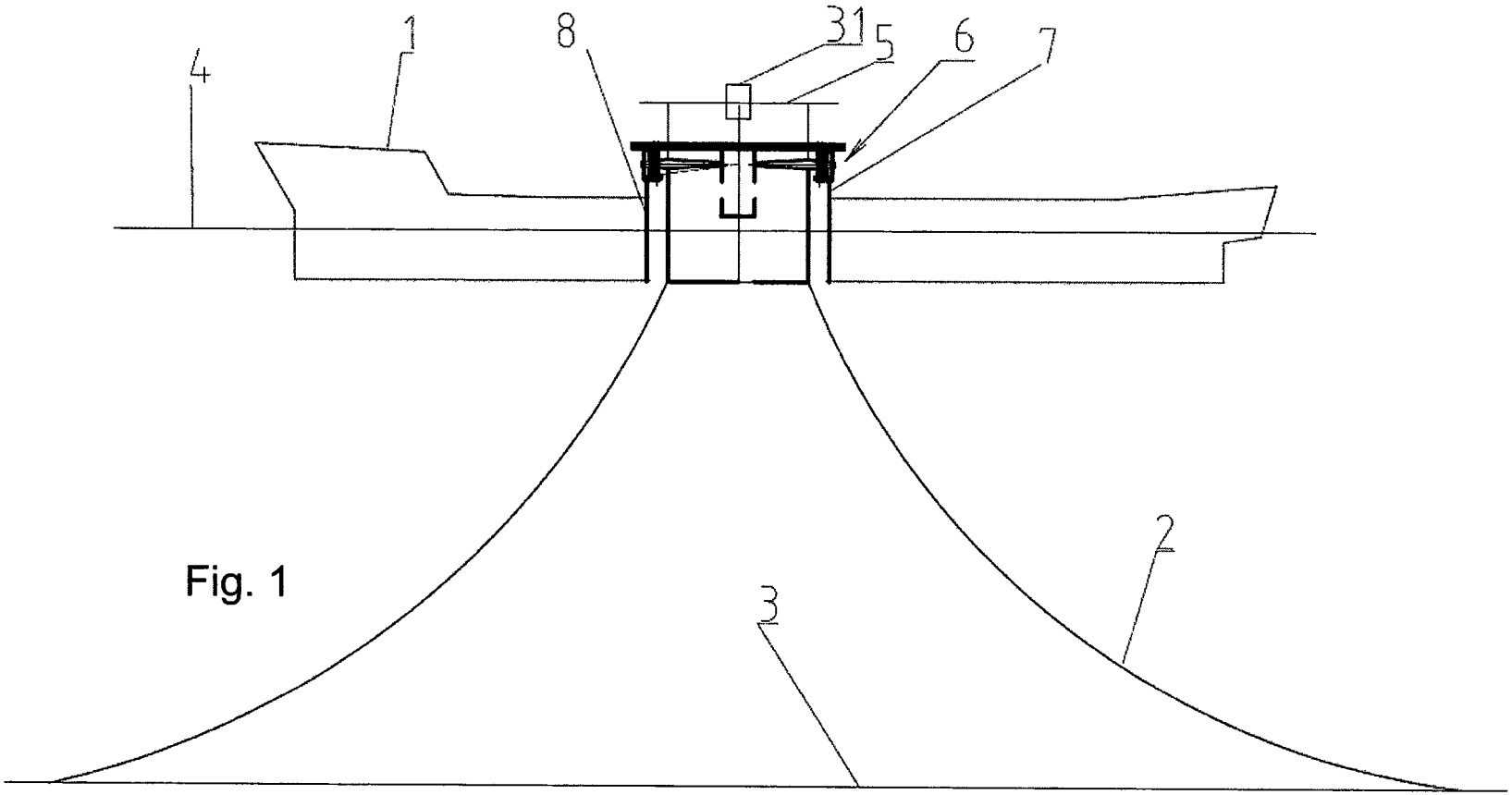
FIG. 1 shows a vessel moored by mooring lines to the sea floor via a rotatable turret located in a turret well in the vessel.

The turret mounted in the vessel shown in FIG. 1 is mounted into a through-going hole/well 8 in the vessel 1. Mooring lines 2 are suspended in the lower portion of the turret, and used for mooring the vessel to the sea floor 3. Risers and cables may also be suspended from the turret to the sea floor or to a structure or a floating unit in its vicinity. A turret bearing system 6 is mounted onto a bearing support structure 7.

A swivel coupling 31 is used for bridging the conduits and cables across to the vessel.

The vessel may be a large ship or a smaller loading buoy being used for transferring products to or from a vessel moored to the anchored vessel 1.

The bearing system may also be used for turntable simply carrying the weights of the piping and equipment required for the transfer of the products to the vessel.

A further application may be for supporting large drums onto a rail system on the ground. In general, there is no limit to the application of the solution—wherever there is a need for supporting a revolving load relative to the ground will benefit from this solution.

Figure 2:
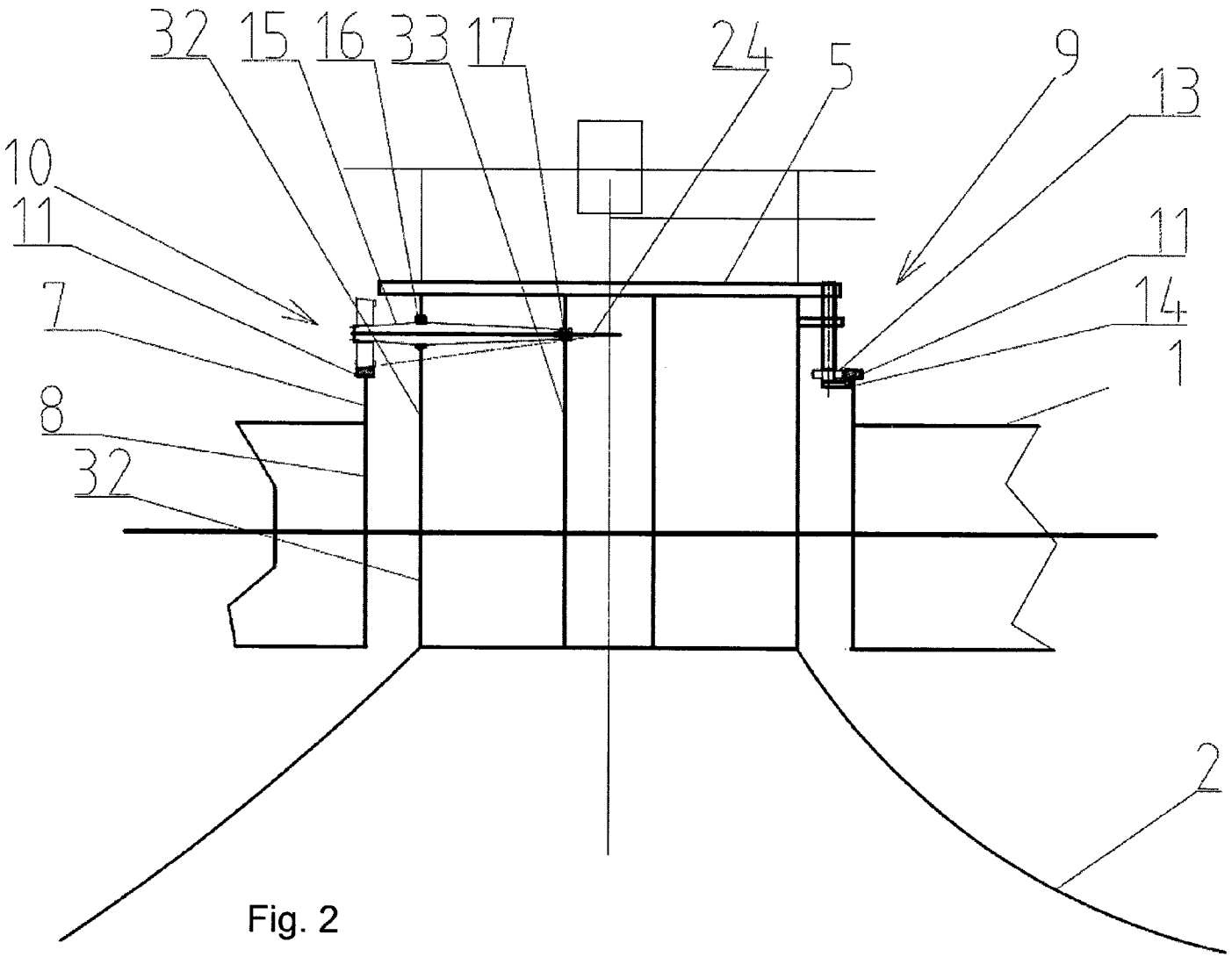
FIG. 2 shows a close-up of the turret with its bearing system in the vessel's turret well. The left section of the figure shows the axial wheel bearing system, and the right half shows the radial bearing system.
Figure 3:
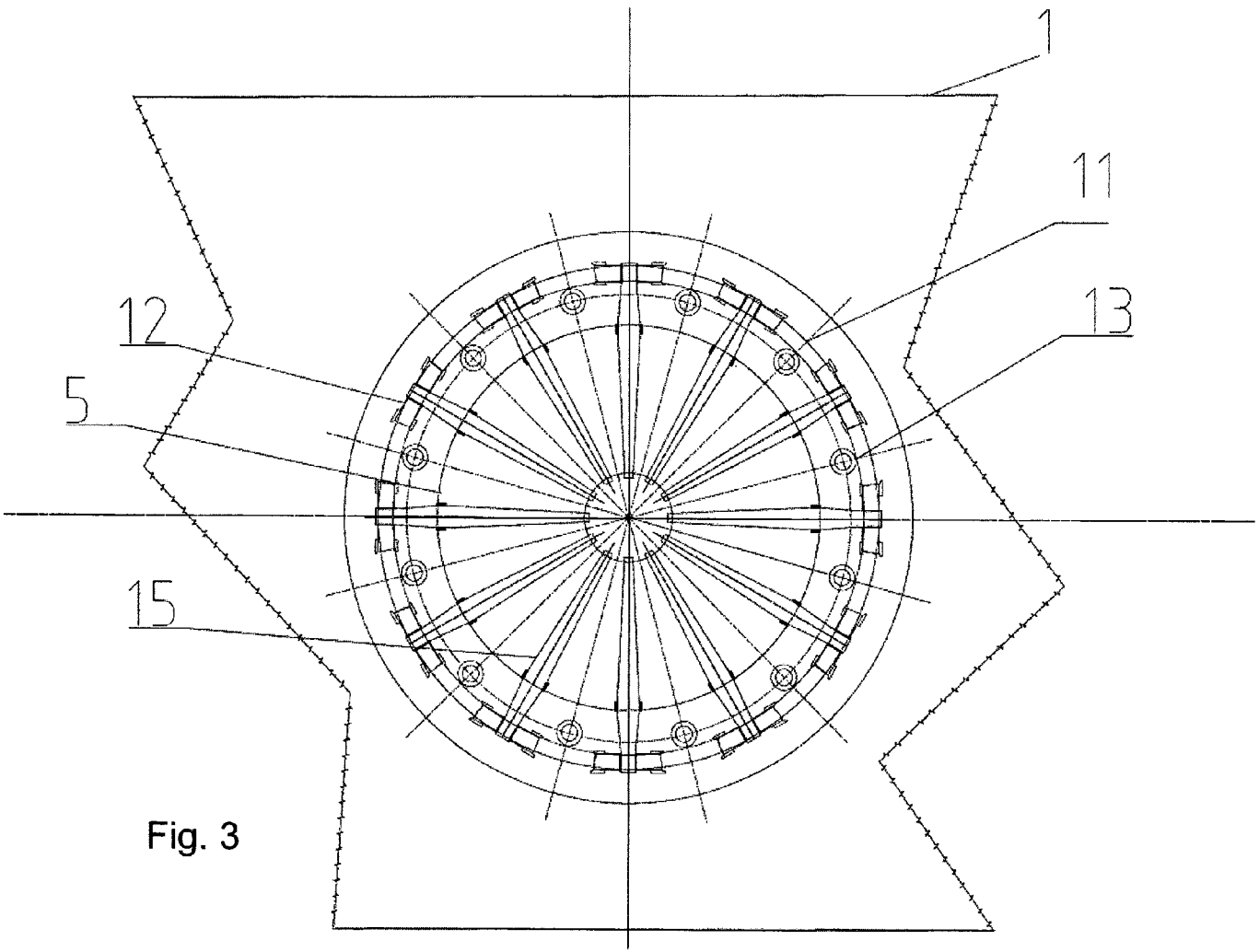
FIG. 3 is a plan view of the bearing arrangement at deck level.

The preferred bearing configuration is shown FIG. 2 and FIG. 3. The axial bearing assembly is shown in the portion to the left for the centre line and the radial bearing assembly is shown in the right hand side.

The turret structure 5 with a downwardly extending skirt or barrel 32 which is substantially cylindrically shaped is supported by a number of axial bearing assemblies 10.

12 axial wheels 12 are mounted onto respective shafts 15.

The bearing assemblies are arranged in a polar array about the turret centre line as illustrated in FIG. 3. The conically shaped axial wheels 12 are rolling on a circular rail 11 with an upward conically shaped surface. The radial bearing system 9 are here shown arranged with equal number of substantially horizontally mounted wheels. The number of radial wheel bearing units may be different from that of the axial bearing units.

Figure 4A:
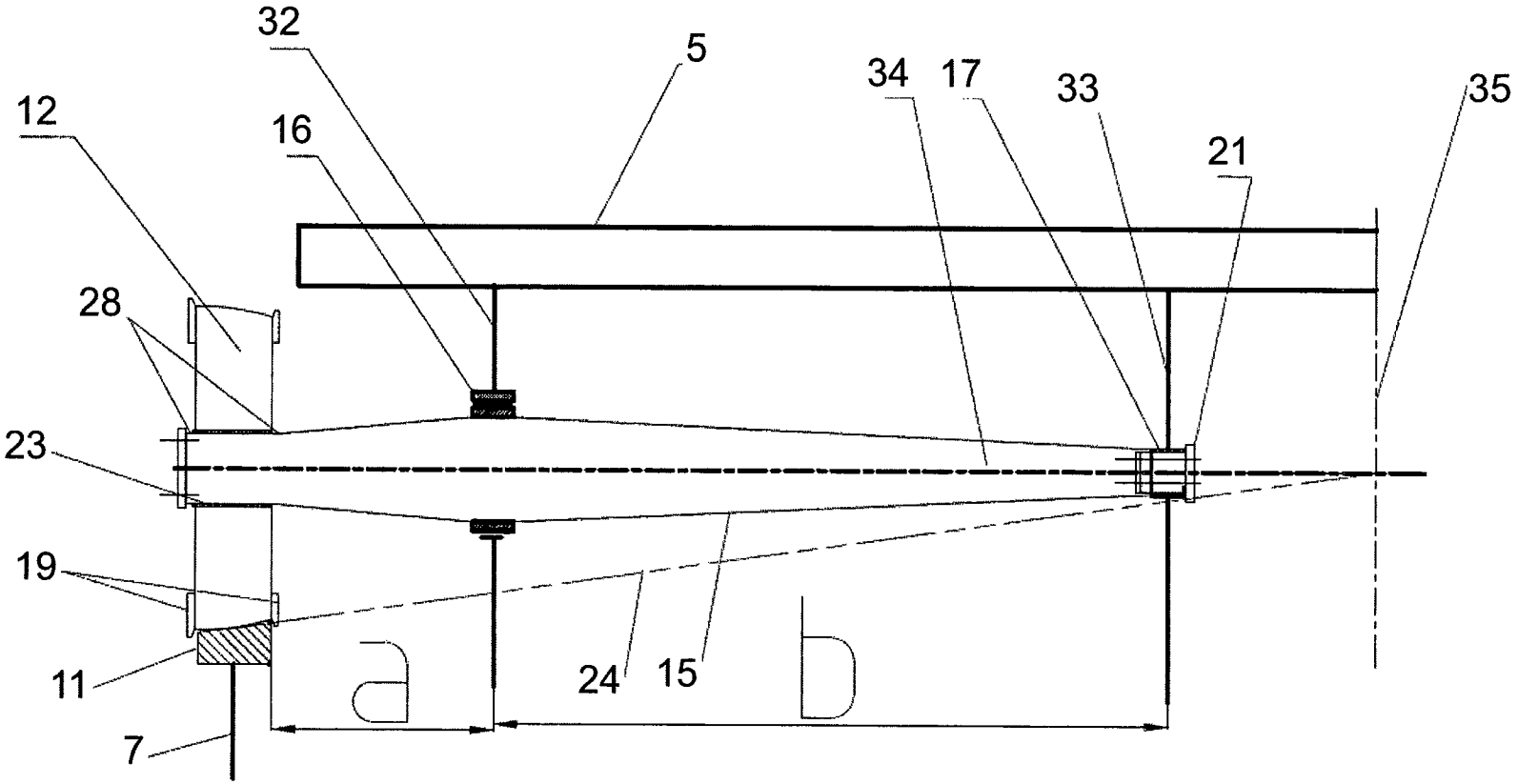
FIG. 4A shows an axial wheel assembly including a shaft with inward and outward support in the turret/turntable.

FIG. 4A shows that the axial wheel 12 is mounted onto the shaft 15 a distance "a" from the outward support 16 arranged substantially aligned with the skirt 32. The shaft's inward end is supported by the bearing 17 aligned substantially with the inward column or skirt 33 arranged a distance "b" apart.

The wheel body 12 with its bearing liner 23 is free to move along the slid-able portions 28 of the shaft 15. The wheel's radial position along the shaft is controlled by the flanges 19. The flanges are either bolted to the wheel body 12 or being a part of the same piece, which preferably is a forging or a casting.

The shaft's inward termination is axially locked to the support 17 by a nut 21. The nut is fixed to the shaft by bolts or other means. The preferred embodiment for the locking device is with a nut having a cylindrical body protruding in an inwardly directed and complementary shaped hole in the inward end of the shaft as shown in the close up in FIG. 4A. The nut is preferably fixed to the shaft by bolts. The nut is retrievable (to the left in the figure) whereby the shaft's inward (left end in FIG. 4A) end may be tilted down and the shaft with wheel may finally be retrieved.

The support 16 is comprised of an elastomer element or equivalent easily displaceable in the horizontal plane and aligned with the shaft centre line (plane normal to the paper plane), but is resilient to angular movements/deflections in the paper plane.

The support 17 in the inward termination of the shaft is a ring or equivalent welded into the inner column 33.

FIG. 4A further shows that the rail 11 has a cross section with an upward facing edge with a slope aligned with an extension line 24 substantially intersecting with the shaft centre line 34 at the centerline 35 for the turret.

Figure 6A:
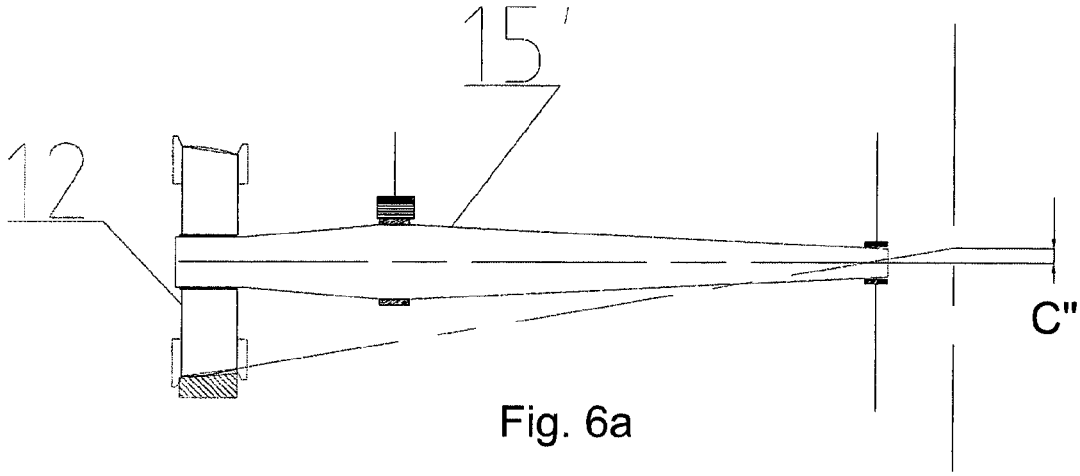
FIG. 6A-6C shows the principles for the structural flexibility of the shaft in combination with the geometric shape of the axial wheel.
Figure 6B:
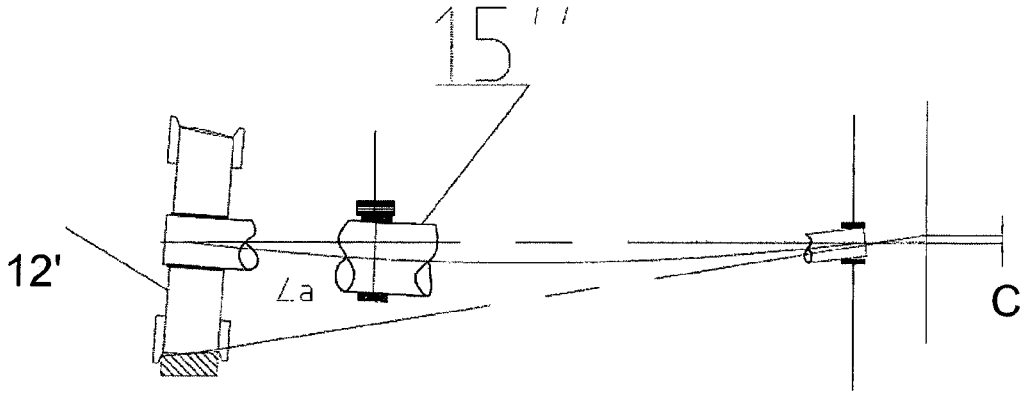

Likewise, the extension line for the conically shaped wheels is preferably intersecting the turret centre at the same point in the normal operating loaded condition, or a minor distance c away as illustrated in FIG. 6B, above or below, from the unloaded shaft centre line. The distance c is preferably close to 0 in the operating mode providing the best rolling and wearing properties.

The shaft is straight in the unloaded condition and the intersecting point is a small distance c" above the shaft centre line as illustrated in FIG. 6A. As the shaft deflects under high loads, the intersecting point is descending along the turret centre line, peaking at a distance c' in FIG. 6C at max wheel load. The wheel then tilts to its max angle <a'.

Figure 4B:
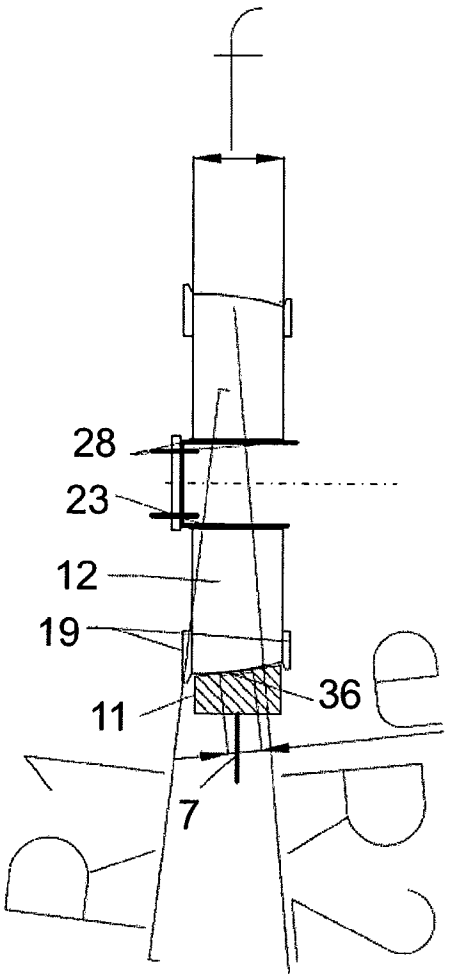
FIG. 4B shows the principles for the contact surface between the axial wheel and the rail.

The wheel has as illustrated in FIG. 4 and FIG. 6 double curved surface. The width of the wheel and a rail is marked "f" in FIG. 4B. The width of the contact surface between the wheel and the rail is marked "e" in the same illustration and is less than is the width of the rail to ensure that there will not be edge contact between the end faces of the wheel and the rail when the shafts deflects under the effects of weights, mooring and riser loads, and other dynamic loads. The relationship between the stiffness of the shaft and the length of the said arms are tuned to obtain a suitable deflection of the wheel relative to the turret/turntable for the purpose of ample load sharing between the individual wheels.

The shaft 15 has a decreasing diameter for obtaining more flexibility and less weight.

The cross sectional curvature of the wheel is illustrated by radius of curvatures R1 and R2 in FIG. 4B. The wheel may have both a constant radius, two different radius or a parabolic/elliptic cross section. The smaller diameter is at the outward portion, R1 to the left in the figure, and the larger R2 is preferably in the inward portion of the wheel. The load bearing capacity of the wheel increases substantially with an increase of the radius of curvature.

Figure 6C:
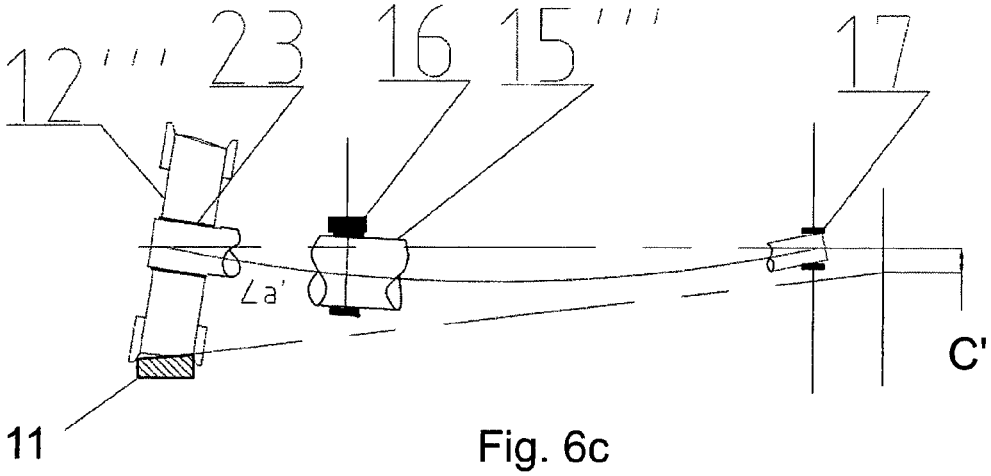

The width of the contact surface illustrated with "e" in FIG. 4B shifts from the outward portion of the rail to the inward as the load onto the wheel is increasing, so will the load bearing capacity increase by the increase of the radius of curvature when the wheel tilts, <a to <a' in FIGS. 6B and 6C. FIG. 6A illustrates a wheel shaft assembly as built, substantially straight in the unloaded condition. In this position, the contact area between the wheel and the rail is at the outward extremity, to the far left in the figure. Therefore, the width of the rail and the wheel may be kept moderate even with a wheel tilting a little under load.

Figure 5:
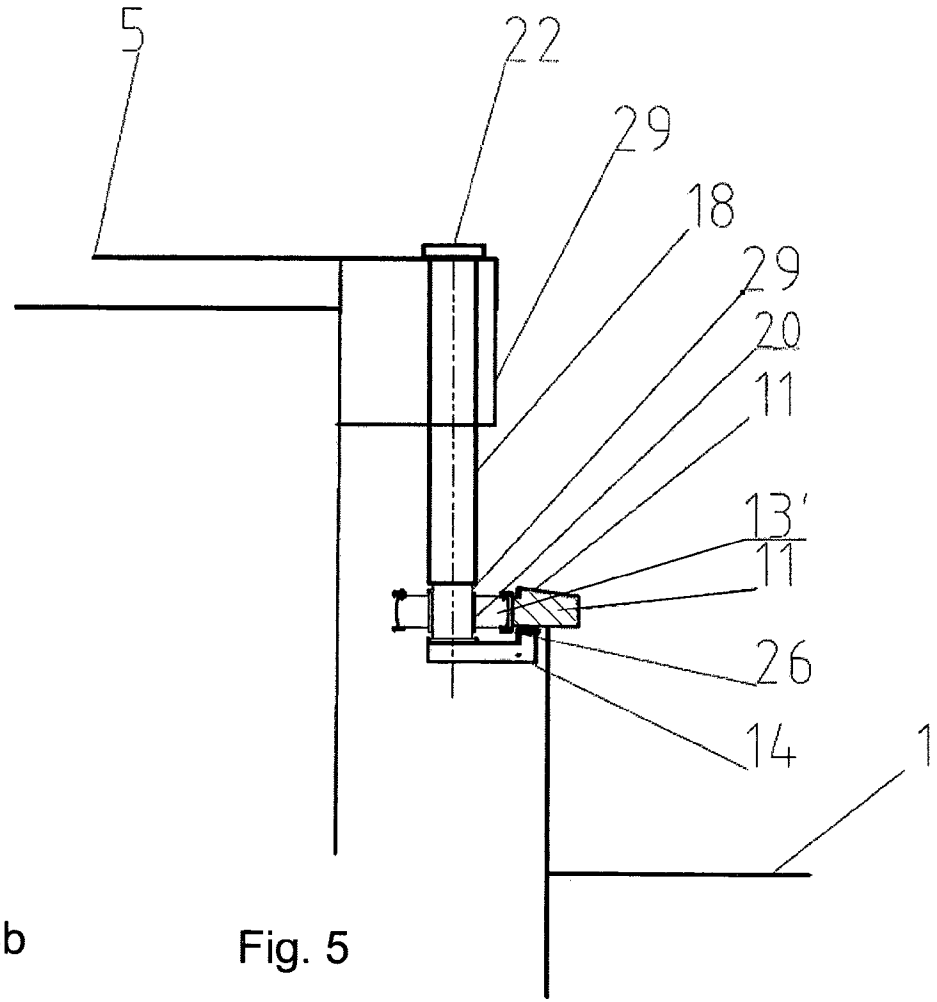
FIG. 5 shows a close up of the radial wheel assembly

FIG. 5 illustrates a preferred embodiment of the radial bearing assembly. It is comprised of a horizontally arranged wheel 13' also with double curved surface. The wheel has flanges 26 with a bearing liner 20 allowing the wheel 13' to freely move vertically along the slid-able surfaces 29 on both sides of the wheel. The flanges are preferably bolted, but may also be a fixed part of the wheel. The shaft 18 is clamped into the structure 29, part of the turret/turntable structure 5, and protrudes downwardly some distance sufficient to obtain a suitable flexibility so that the radial wheel flexes somewhat for load sharing purposes.

The radial wheel 13 is in like manner as the axial wheel shaped with double curved surface allowing the wheel to tilt according to its angular deflection of the shaft 18.

The shaft 18 is locked axially by a nut 22. This nut may be bolted and fixed to the shaft in likewise manner as the shaft for the axial wheel are fixed to the inward column as described above permitting the shaft to be released from the structure 29 and retrieved.

A hook 14 is mounted in the lower portion of the radial wheel assembly. The hook grips underneath the rail 11 as shown in FIG. 5.

Figure 7:
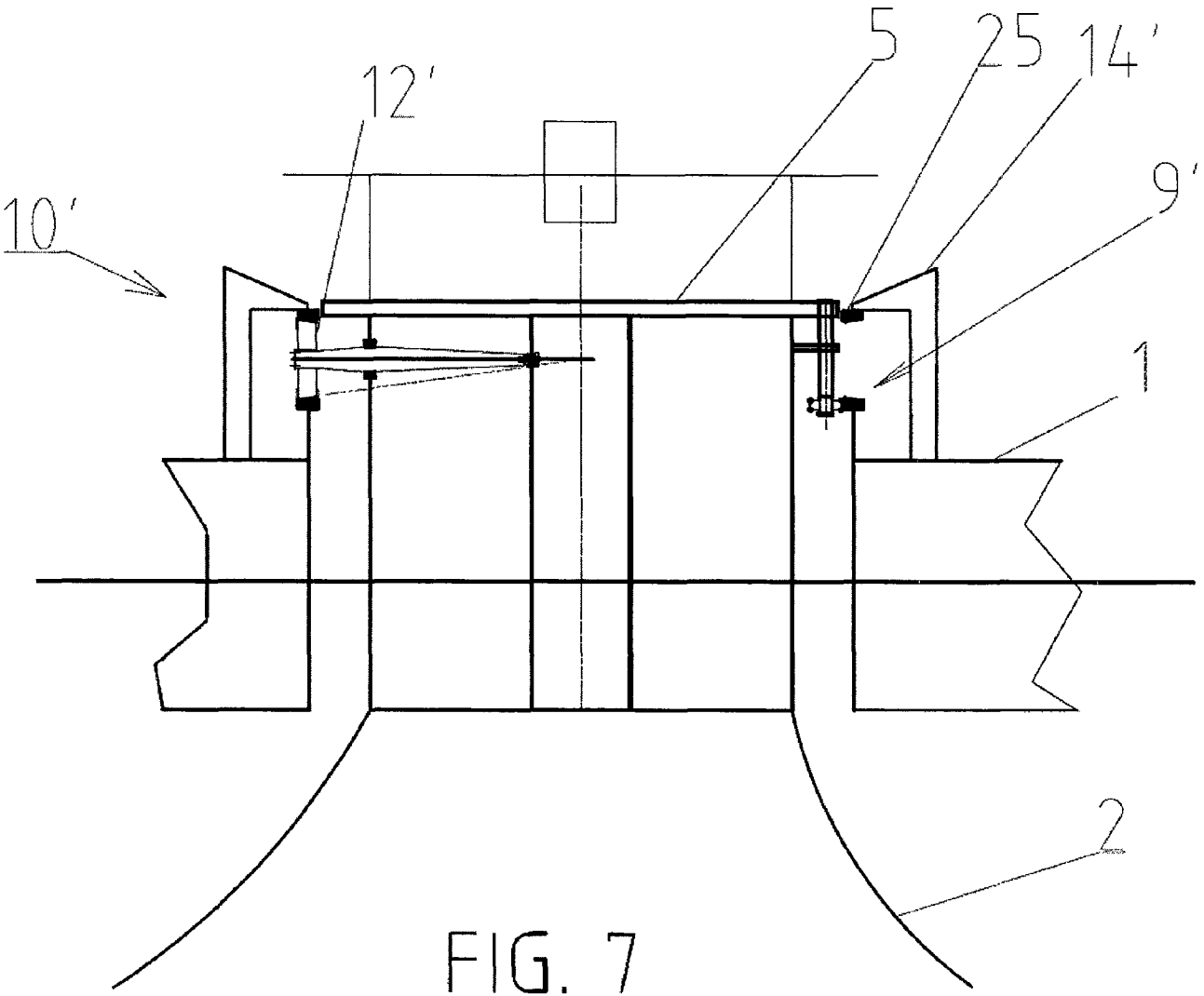
FIG. 7 shows an alternative configuration of the bearing system with a separate rail for handling the negative loads from overturning load effects.

FIG. 7 is showing a turret/turntable with an alternative overturning arrangement comprising a hook 14' and a rail 25 restraining the wheel 12' from uplift.

Figure 8:
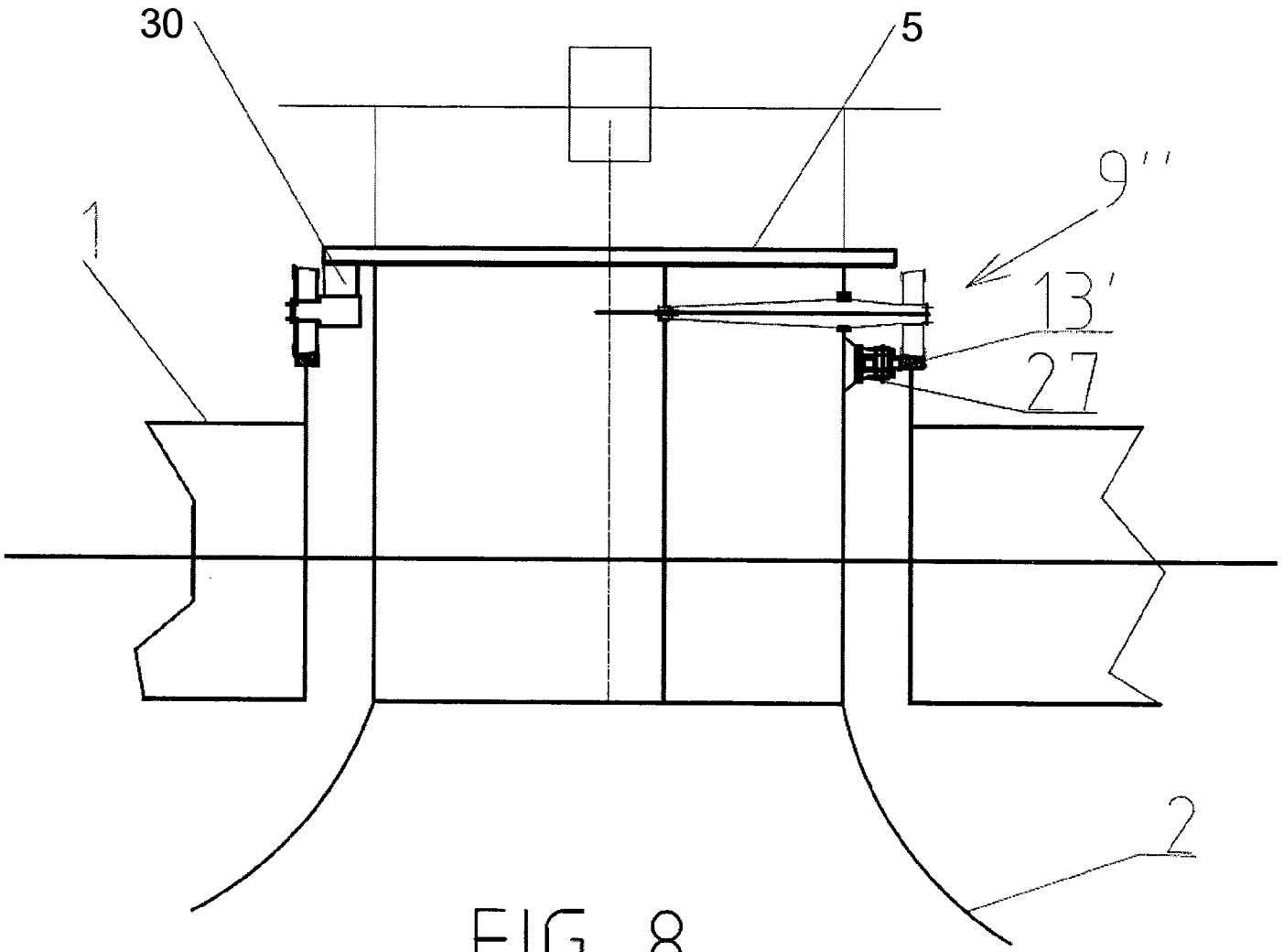
FIG. 8 shows a turret arrangement with an alternative arrangement for the support of the radial wheels using flexible elements instead of structural elements, and a flexible element for handling the required flexibility of the axial wheels.

FIG. 8 show alternative suspension arrangements for the axial bearing and the radial bearing on the left and right side of the centerline respectively. The suspension device 30 for axial wheel is a flexible element, hydraulic cylinder with, or without, suspension arms.

The suspension device 27 for the radial wheel 13' in FIG. 8 is a stiff or flexible element with or without vertically displaceable features. This type of suspension facilitates arrangement with radial wheel spacing independent of the axial wheel spacing.

The turret shown in FIG. 8 does not have any overturning preventer, which is not required in all cases.

The radial wheel 13 in FIG. 2 is without flange since the wheel and the shaft is non-resilient in the vertical direction.

The advantage with the conically shaped wheels is that the wheels inherently tend to follow the track. The consequent advantage is that the flanges are insignificantly subject to wear. Neither will there be any slip between the wheel and rail also significantly reducing the wear between the wheel and the rail.

The advantage with using shafts and equivalent non welded structures for structural spring elements is that they have superior fatigue strength as compared with welded structures. High yield strength and non-weld-able materials may be used requiring smaller elements to achieve the same deflection.

This solution combines the advantage of these two significant contributions to a light structure with long endurance life and easy to maintain.

The invention claimed is:

1. A turret and turntable bearing for a vessel, such as a drilling or production vessel for recovery of oil offshore, the turret being rotatable in a through-going opening or well in the hull of the vessel and having axial and radial bearing assemblies arranged in a polar array about the turret center line, wherein the axial bearing assembly includes axial wheel shafts acting as bearing arms, each axial wheel shaft having one axial wheel rolling on a circular rail on the bearing support structure, each axial wheel shaft secured to the turret structure, the axial wheels are conically shaped with a double curved surface rolling on the upward facing edge of the circular rail with a slope aligned with an extension line of the rail substantially intersecting with the shaft center line at the center line of the turret, the conically shaped axial wheels are substantially following the extension line of the rail, the radial bearing assembly includes horizontally arranged radial wheels with double curved surfaces, each wheel is mounted on a shaft secured to the turret, the radial wheels rolling on an inward facing edge of the circular rail.

2. The turret and turntable bearing according to claim 1, wherein each axial wheel shaft is supported in an outer shaft support in a downwardly extending barrel of the turret structure, each axial wheel shaft is further releasable supported in a support at its inward end to an inward column.

3. The turret and turntable bearing according to claim 2, wherein each axial wheel shaft has a decreasing diameter from each side of the shaft support.

4. The turret and turntable bearing according to claim 2, wherein the inward end of the shaft is axially locked to the support by a nut (21).

5. The turret and turntable bearing according to claim 1, wherein the shaft of the radial bearing assembly is clamped into a structure of the turret and protruding downwardly.

6. The turret and turntable bearing according to claim 5, wherein a hook is mounted in the lower portion of the radial bearing assembly, the hook grips underneath the rail.

7. The turret and turntable bearing according to claim 1, wherein each axial wheel shaft is secured to a flexible suspension device fastened to the turret.

8. The turret and turntable bearing according to claim 1, wherein hooks provided with a rail are mounted on the vessel restraining the axial wheels from uplift.

9. The turret and turntable bearing according to claim 1, wherein each shaft of the radial bearing assembly for the radial wheels is secured to a suspension device fastened to the barrel of the turret.

10. The Turret and turntable bearing according to claim 2, wherein the shaft of the radial bearing assembly is clamped into a structure of the turret and protruding downwardly.

11. The Turret and turntable bearing according to claim 3, wherein the shaft of the radial bearing assembly is clamped into a structure of the turret and protruding downwardly.

12. The Turret and turntable bearing according to claim 4, wherein the shaft of the radial bearing assembly is clamped into a structure of the turret and protruding downwardly.

13. The Turret and turntable bearing according to claim 2, wherein hooks provided with a rail are mounted on the vessel restraining the axial wheels from uplift.

14. The Turret and turntable bearing according to claim 3, wherein hooks provided with a rail are mounted on the vessel restraining the axial wheels from uplift.

15. The Turret and turntable bearing according to claim 7, wherein hooks provided with a rail are mounted on the vessel restraining the axial wheels from uplift.

* * * * *